US007194807B2

(12) United States Patent
Weiss

(10) Patent No.: US 7,194,807 B2
(45) Date of Patent: Mar. 27, 2007

(54) SANITARY NAIL CLIPPERS

(76) Inventor: Edward Weiss, 1222 Caldwell Ct. North, Belcamp, MD (US) 21017

( * ) Notice: Subject to any disclaimer, the term of this patent is extended or adjusted under 35 U.S.C. 154(b) by 92 days.

(21) Appl. No.: 11/185,064

(22) Filed: Jul. 20, 2005

(65) Prior Publication Data

US 2006/0016079 A1 Jan. 26, 2006

Related U.S. Application Data

(60) Provisional application No. 60/589,605, filed on Jul. 21, 2004.

(51) Int. Cl.
*A45D 29/02* (2006.01)

(52) U.S. Cl. ..... 30/28; 132/75.5

(58) Field of Classification Search ..... 30/26–29, 30/109, 111, 113, 175, 278, 279.2, 182, 341, 30/131; 132/75.4, 75.5; D28/56, 60; 83/692, 83/693, 694

See application file for complete search history.

(56) References Cited

U.S. PATENT DOCUMENTS 257,925 A * 5/1882 Faas ..... 30/113
283,055 A * 8/1883 Yates ..... 30/113
589,405 A * 9/1897 Billings ..... 30/113
672,157 A * 4/1901 Willard ..... 30/113
964,561 A * 7/1910 Salviolo ..... 30/113
1,085,473 A * 1/1914 Peden ..... 30/278
1,908,890 A * 5/1933 Burns ..... 30/113
2,467,589 A * 4/1949 Johansson ..... 30/27
2,493,979 A * 1/1950 Kudd ..... 30/113.2
2,540,782 A * 2/1951 Hansen ..... 30/27
4,944,092 A * 7/1990 De Groot et al. ..... 30/134

* cited by examiner

*Primary Examiner*—Stephen Choi
(74) *Attorney, Agent, or Firm*—Ober/Kaler c/o Royal W. Craig

(57) ABSTRACT

Nail clippers having both shielded cutting blades to prevent intentional or accidental injury and an integral means for collecting clipped nails. The nail clippers include two hollow cylindrical housings each having both a closed and open end. The edges of the open ends of both housings each have a corresponding concave sharpened section, forming the cutting edges of a nail clipping slot. The housings are both slideably connected to and spring biased against each other. A nail inserted into the nail clipping slot is clipped by squeezing the housings together. Clipped nails are collected in the closed end of one of the housings. The closed end may be opened and/or removed to discard the clippings.

12 Claims, 2 Drawing Sheets

SANITARY NAIL CLIPPERS

CROSS-REFERENCE TO RELATED APPLICATION(S)

The present application derives priority from U.S. Provisional Patent Application 60/589,605 filed: Jul. 21, 2004.

BACKGROUND OF THE INVENTION

1. Field of the Invention

The present invention relates to fingernail and toenail clippers and, more particularly, to clippers for cutting the distal end of the nail plate wherein the cutting edge is shielded and the structure of the clippers further comprises an integral clipping collector.

2. Description of the Prior Art

Conventional finger and toenail clippers are almost invariably comprised of lever-actuated jaws having exposed sharpened edges. The lever is attached to a post that that is fixedly mounted at one end to the first jaw and slidably mounted at the other end to the second jaw. The jaws are held open by a natural spring bias. They are closed by manipulating the lever, which compresses the second jaw towards the first. The distal end of the nail plate is placed between the sharp jaw edges and is cut as the edges come together. U.S. Pat. No. 4,637,137 to Husain is one example of nail clippers having this basic structure.

There are at least three primary disadvantages to the structure of conventional nail clippers. A first disadvantages is that the cutting edges on each jaw are exposed. A second disadvantages is that there is no integral guard that would prevent the user from cutting the nail too far down. Given the exposed cutting edges and lack of safety guard, conventional clippers may cause accidental injury if used by children or in an irresponsible manner. There is also the potential for such clippers to be used as a weapon. A third notable disadvantage is that the conventional nail clippers spew out all nail clippings, leaving an unsanitary mess behind. The Husain '137 patent attempts to provide a safety guard to prevent the user from cutting the nail down too far, but it does not address the problems of the exposed cutting edge or scattered nail clippings.

U.S. Pat. No. 2,540,782 to Hansen discloses a non-conventional nail clipper structure. The nail clippers comprise a first housing slidably mounted within a second housing. A compression spring extends the length of the first housing and rests on an abutment extending the length of the second housing. The second housing has nail insertion slot and both the housings are contoured over the length of the housing on the slot side to match the curvature of a finger. The inside of the first housing is further defined by a knife edge. If the housing ends are squeezed together, such that the first housing slides against the resistance of the spring into the second housing, a finger nail inserted into the nail slot would be clipped by the knife edge. An outlet opening in the second housing allows the clipped nails to be expelled.

A number of disadvantages are associated with the Hansen '782 nail clippers. First, users may be reluctant to stick their fingernail in the slot to be clipped because the cutting edge is not visible. Second, since the nail plate must pass through a slot the thickness of which is at least the sum of the thickness of both housing before reaching the cutting edge, the user may not be able to cut the nail as close to the hyponychium (point of attachment between the skin of the finger or toe and the distal end of the nail) as desired. Third, the matching concave contours of the housings, nail slot, and cutting edge allows the shape of the clipped nail to match that of the finger tip, but does not push the fingertip skin away from the nail to prevent accidental cutting of the fingertip skin and to allow the cutting edge to cut as close to the hyponychium as possible. Lastly, while the Hansen '782 nail clippers provide an outlet for expelling the clipped nails, they do not provide a means to collect the clipped nails and expel them as desired (i.e. over a trash can).

Therefore, it would be advantageous over the prior art to provide finger- or toe-nail clippers having shielded cutting edge(s) in order to prevent intentional or accidental injury. It would further be advantageous over the prior if such nail clippers were structured to allow the user to view the cutting edge in operation and to clip the nail as close as possible to the hyponychium without causing injury to the finger or toe. Lastly, it would be advantageous to provide an integral vessel for collecting clipped nails, with removable cover to allow convenient discarding at will.

SUMMARY OF THE INVENTION

It is, therefore, an object of the present invention to provide effective fingernail and toenail clippers having a shielded, but visible, cutting edge for preventing intentional or accidental injury.

It is another object of the present invention to provide nail clippers having an integral vessel for collecting clipped nails, with removable cover to allow convenient discarding at will.

The foregoing and other objects are accomplished by providing a nail clipper formed by a first and second cylindrical housing sections, each with the same diameter and each having both a closed and open end. The closed end of the first housing captures clipped nails and is openable. The first and second housings are both spring biased against each other and slidably engaged and connected together.

A guide/connector, connects the two housings and is essentially cylindrical in shape. It is inset partially within and mounted to the first housing. It is telescopically and slidably engaged into the second housing and connected thereto by a connection comprising three angularly-spaced longitudinal slots indented (or cut) into the guide/connector, and three corresponding rivets protruding into the slots from the second housing section.

Corresponding edges of the open ends of the first and second housings are further defined by corresponding concave sections each sharpened to form a first and second cutting edge, respectively, of a nail cutting slot. The concave contour of the cutting edges does not extend the length of the housings but rather tapers to form a dimple around the nail cutting slot.

The guide/connector is further defined by a cutaway that allows a finger or toe nail to be inserted into the nail slot and also accommodates and guides the concave edge of the second housing as it slides towards the first housing.

Spring loaded action of the nail clippers is provided by a compression spring mounted inside the guide/connector, above the edge of the first housing, and abutting the closed end of the second housing.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figures 1, 2:
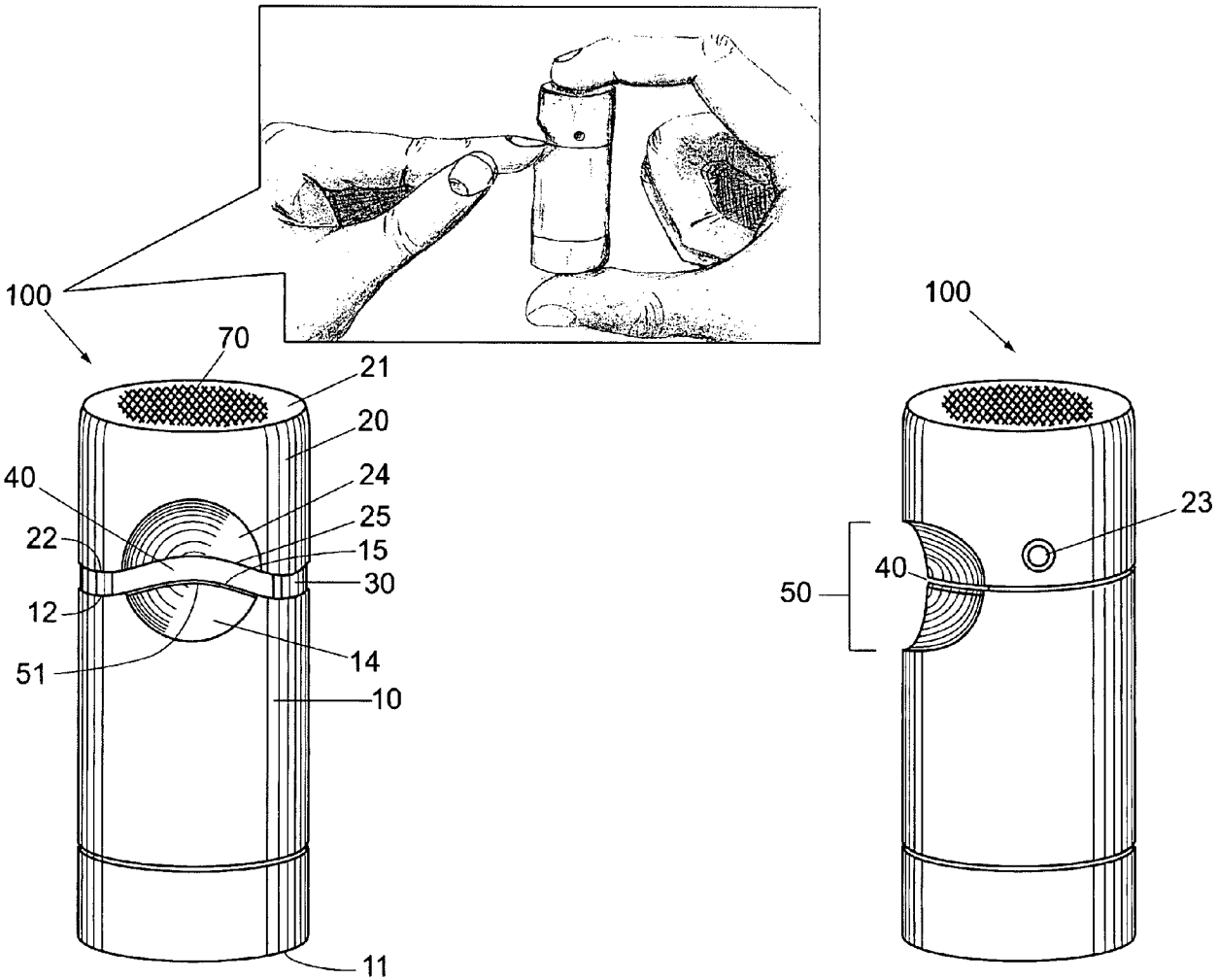
FIG. 1 is front view of the nail clippers 100 of the present invention with the nail cutting slot open.
FIG. 2 is a side view of the nail clippers 100 as in FIG. 1, with the nail cutting slot closed.

Referring to FIG. 1, the present invention is a sanitary nail clipper 100, generally comprising first and second hollow cylindrical housing sections 10, 20, each having substantially the same diameter and with opposing open ends 12, 22 having facing annular edges. The facing edges of the first and second housing sections 10, 20 are further defined by corresponding indentations that define concave lips 14, 24, the facing edges within the concavity being sharpened to form opposing cutting edges 15, 25. A tubular guide/connector 30 having an external diameter conforming to the interior of the first and second housing sections 10, 20 is fixedly anchored in the second section 10 and is slidably inserted into the first housing section 20. When the first and second housing sections 10, 20 are interconnected by the guide/connector 30 a nail cutting slot 40 is defined, flanked by the two corresponding cutting edges 15, 25.

As seen in FIG. 2, the contour of the concave lips 14, 24 does not extend the length of the housings but rather both taper inwardly to collectively form a finger-tip-sized recess 50 around the nail cutting slot 40. One's finger-tip can be comfortably seated in the recess 50 with fingernail oriented into the nail cutting slot 40, and the first and second housing sections 10, 20 compressed together to trim the fingernail between the two corresponding cutting edges 15, 25.

Figure 3:
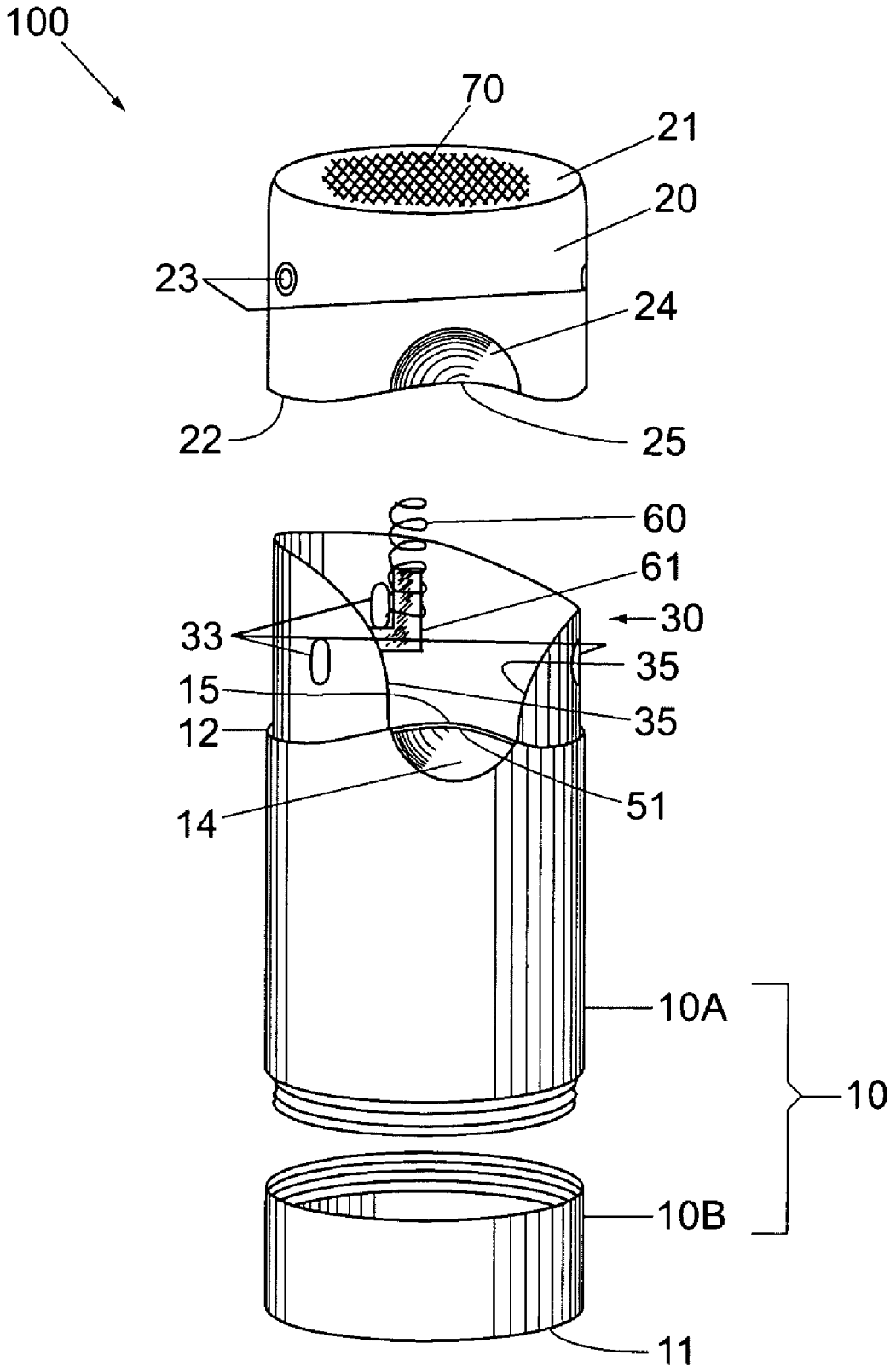
FIG. 3 is a perspective view of the nail clippers of FIGS. 1 and 2 with primary features separated for illustration purposes.

FIG. 3 is a perspective view of the nail clippers of FIGS. 1 and 2 showing the guide/connector 30 that joins housing sections 10 and 20. Guide/connector 30 is essentially cylindrical in shape. One end of the guide/connector 30 is partially inserted into and is fixedly mounted within (i.e. by welds, screws, bolts, etc.) the first housing section 10 adjacent its open end 12. The other end the guide/connector 30 is partially inserted into but slidably and telescopically engaged within the second housing 20. In the preferred embodiment, this telescopic engagement between the second housing 20 and the guide/connector 30 is accomplished with three angularly-spaced longitudinal slots 33 indented (or cut) into the guide/connector 30, and three corresponding rivets 23 protruding into the slots 33 from the second housing section 20. Slots 33 are of predetermined length to allow a limited degree of sliding freedom. Thus, the pins 23 sliding within slots 33 allow the second housing 20 to slide towards and away from the first housing 10 without detaching.

The guide/connector 30 is further defined by a cutaway 35 to provide a clearance around the finger-tip-sized recess 50 about the nail cutting slot 40 that allows a finger or toe nail to be freely inserted into the nail slot 40, and also to accommodate and guides the concave edge 24 of the second housing 20 as it slides towards the first housing 10.

The first and second housing sections 10, 20 are biased apart to provide a spring-loaded action, and this is accomplished with a compression spring 60 mounted inside the guide/connector 30, above the open end 12 of the first housing 10 and abutting an abutment means in the second housing 20. In the preferred embodiment an L-shaped arm 61 is attached to the guide/connector 30 and extends vertically along the center axis of the device 100 towards the closed end 21. The spring 60 is secured to and rests upon arm 61 at one end and abuts closed end 21 at its other end.

The closed end 11 of the first housing section 10 serves as an integral container for collecting clipped nails, and incorporates a removable closure for emptying trimmings. For example, the closed end 11 may be designed for easy hinged-opening, or removal (e.g., by jointed, compression-fit, or screw-threaded end cap) in order to dispose of collected nail clippings. In the illustrated embodiment the first housing 10 is subdivided into a primary vessel 10*a* with screw-threaded rim and a cooperating screw-threaded cap 10*b* for removable attachment. The cap 10*b* is preferably of sufficient length to serve as a container for collected clipped nails.

The closed ends 11, 21 are preferably textured with a non-slip surface 70 to prevent slipping of the fingers during use of the device 100.

In operation, a user places their fingernail in the nail cutting slot 40 with the visible cutting edges 15, 25. The guide/connector 30 and recess 50 surrounding the cutting slot 40 serves to shield the cutting edges 15, 25, limiting their exposure and thereby preventing accidental or intentional injury. As the nail is inserted into the slot 40, the tapered edge 51 of the recess 50 pushes in on the fingertip skin pulling the skin adjacent the hyponychium down and away from the nail. This allows the user to cut the nail close to the hyponychium without risk of cutting the fingertip skin. Once the nail is inserted into the slot 40 to the desired depth, the user squeezes the closed ends 11, 21 of the first and second housings 10, 20 together against the spring 60 bias and thereby slides the second housing 20 on its pin 23 along slot 33 of the guide 30 towards the first housing 10. The nail is clipped as the cutting edges 15, 25 of the first and second housings are engaged. The clipped nail falls to the through the hollow first housing 10 to the closed end 11. The closed end 11 of the first housing is later opened or removed for emptying the clipped nails at will.

The device 100 of the present invention may be constructed using a variety of materials, including metal and durable plastic. In addition the device 100 may be constructed in a variety of sizes to accommodate infant, child, and adult-size finger and toe nails. In all such variations it provide effective fingernail and toenail clipping with a shielded, but visible, cutting edge that prevents intentional or accidental injury. In addition, the integral collection vessel for clipped nails, and removable cover, allow more convenient disposal.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

I claim:

1. An apparatus for clipping finger and toe nails, comprising:

a tubular first housing section having an open end defining an edge, a portion of said edge being indented and sharpened within the indentation to define a recessed first cutting blade;

a tubular second housing section having an open end defining an edge, a portion of said edge being indented and sharpened within the indentation to define a recessed second cutting blade;

a guide/connector for fixedly inserted into one of said first and second housing sections and slidably inserted in the other of said first and second housing sections for guiding said first and second cutting blades together;

a compression spring seated inside said first and second housing sections and biased there between;

whereby nail trimmings clipped by said apparatus are contained therein until emptied by a user.

2. The apparatus for clipping finger and toe nails according to claim 1, wherein trimmings clipped by said apparatus are contained within said first housing section, and said first housing section further comprises a removable closure for emptying said trimmings.

3. The apparatus for clipping finger and toe nails according to claim 1, wherein said first housing section and second housing section have equal interior diameters, and said guide/connector comprises a tubular member having an external diameter conforming to the interior diameter of the first and second housing sections.

4. The apparatus for clipping finger and toe nails according to claim 3, wherein said guide/connector is defined by a cutaway to provide a clearance around the recessed first and second cutting blades.

5. The apparatus for clipping finger and toe nails according to claim 4, wherein said guide/connector is telescopically engaged into both of said first and second housing sections and is slidably connected to one via a plurality of longitudinal guide slots in the said guide/connector that slidably cooperate with corresponding rivets in one of said first and second housing sections.

6. The apparatus for clipping finger and toe nails according to claim 1, wherein the indentations of said recessed first and second cutting blades are tapered outwardly to define a recess that conforms to a fingertip, whereby when a fingernail is inserted into the recess, the tapered sides of the recess push in on the fingertip skin to pull the skin adjacent the hyponychium down and away, thereby allowing a close cut to the hyponychium without risk of cutting fingertip skin.

7. An apparatus for clipping finger and toe nails, comprising:

a tubular first housing section having an open end defining an edge, a portion of said edge being indented and sharpened within the indentation to define a recessed first cutting blade;

a tubular second housing section having an open end defining an edge, a portion of said edge being indented and sharpened within the indentation to define a recessed second cutting blade;

a guide/connector for fixedly inserted into said first housing sections and slidably inserted in the second housing section for guiding said first and second cutting blades together;

a compression spring seated inside said first and second housing sections and biased there between;

whereby nail trimmings clipped by said apparatus are contained in said housing sections until emptied by a user.

8. The apparatus for clipping finger and toe nails according to claim 7, wherein trimmings clipped by said apparatus are contained within said first housing section, and said first housing section further comprises a removable closure for emptying said trimmings.

9. The apparatus for clipping finger and toe nails according to claim 8, wherein said first housing section and second housing section have equal interior diameters, and said guide/connector comprises a tubular member having an external diameter conforming to the interior diameter of the first and second housing sections.

10. The apparatus for clipping finger and toe nails according to claim 9, wherein said guide/connector is defined by a cutaway to provide a clearance around the recessed first and second cutting blades.

11. The apparatus for clipping finger and toe nails according to claim 10, wherein said guide/connector is telescopically engaged into both of said first and second housing sections and is slidably connected to one via a longitudinal guide slot in the said guide/connector that cooperates with a corresponding pin in one of said first and second housing sections.

12. The apparatus for clipping finger and toe nails according to claim 11, wherein the indentations of said recessed first and second cutting blades are tapered outwardly to define a recess that conforms to a fingertip, whereby when a fingernail is inserted into the recess, the tapered sides of the recess push in on the fingertip skin to pull the skin adjacent the hyponychium down and away, thereby allowing a close cut to the hyponychium without risk of cutting fingertip skin.

* * * * *

UNITED STATES PATENT AND TRADEMARK OFFICE

CERTIFICATE OF CORRECTION

PATENT NO. : 7,194,807 B2
APPLICATION NO. : 11/185064
DATED : March 27, 2007
INVENTOR(S) : Edward Weiss It is certified that error appears in the above-identified patent and that said Letters Patent is hereby corrected as shown below:

On Title Page, Item (76) should read,

Edward Weiss
2064 Mitford Court
Dacula, GA 30019

Signed and Sealed this

Fifteenth Day of May, 2007

JON W. DUDAS
*Director of the United States Patent and Trademark Office*